US006757218B2

(12) United States Patent
Dubinsky

(10) Patent No.: US 6,757,218 B2
(45) Date of Patent: Jun. 29, 2004

(54) SEMI-PASSIVE TWO WAY BOREHOLE COMMUNICATION APPARATUS AND METHOD

(75) Inventor: Vladimir Dubinsky, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 77 days.

(21) Appl. No.: 10/040,026

(22) Filed: Nov. 7, 2001

(65) Prior Publication Data

US 2003/0086336 A1 May 8, 2003

(51) Int. Cl.[7] ..... G01V 1/40; H01L 11/04

(52) U.S. Cl. ..... 367/83; 367/84; 367/85; 181/103; 181/110; 175/50

(58) Field of Search ..... 367/83–85; 175/50; 181/103, 110

(56) References Cited

U.S. PATENT DOCUMENTS 3,900,827 A 8/1975 Lamel et al. ..... 340/18 NC
4,273,212 A 6/1981 Dorr et al. ..... 181/102
4,535,429 A * 8/1985 Russell et al. ..... 367/87
4,715,022 A * 12/1987 Yeo ..... 367/83
5,119,344 A * 6/1992 Innes ..... 667/184
5,495,237 A * 2/1996 Yuasa et al. ..... 175/50
5,615,172 A * 3/1997 Kotlyar ..... 367/156
6,094,986 A * 8/2000 Wortman et al. ..... 175/50

* cited by examiner

*Primary Examiner*—Nelson Moskowitz
(74) *Attorney, Agent, or Firm*—Madan, Mossman & Sriram, P.C.

(57) ABSTRACT

The present invention provides a semi-passive two-way borehole communication system and method. The system includes a surface source signal generator for generating an acoustic signal. The acoustic source signal is transmitted downhole, and a downhole controllable reflector reflects a portion of the source signal back toward the surface. The reflector is controlled such that an echo signal is created, which contains information to be carried to the surface. A surface receiver is used to detect the echo signal, and a surface controller is used to decode the echo signal.

24 Claims, 5 Drawing Sheets

SEMI-PASSIVE TWO WAY BOREHOLE COMMUNICATION APPARATUS AND METHOD

BACKGROUND OF THE INVENTION

1. Field of the Invention

The present invention generally relates to communications systems for use in oilfield applications and more particularly to an apparatus and method for transmitting acoustic signals between a surface location and a downhole location in a well.

2. Description of the Related Art

The control of oil and gas production wells constitutes an on-going concern of the petroleum industry due, in part, to the enormous monetary expense involved as well as the risks associated with environmental and safety issues.

One type of conventional production system utilizes electrical submersible pumps (ESP) for pumping fluids from downhole. In addition, there are two other general types of productions systems for oil and gas wells, namely plunger lift and gas lift. Plunger lift production systems include the use of a small cylindrical plunger which travels through tubing extending from a location adjacent the producing formation down in the borehole to surface equipment located at the open end of the borehole. In general, fluids that collect in the borehole and inhibit the flow of fluids out of the formation and into the well borehole are collected in the tubing. Periodically, the end of the tubing is opened at the surface and the accumulated reservoir pressure is sufficient to force the plunger up the tubing. The plunger carries with it to the surface a load of accumulated fluids that are ejected out the top of the well thereby allowing gas to flow more freely from the formation into the borehole to be delivered to a distribution system at the surface. After the flow of gas has again become restricted due to the further accumulation of fluids downhole, a valve in the tubing at the surface of the well is closed so that the plunger then falls back down the tubing and is ready to lift another load of fluids to the surface upon the reopening of the valve.

A gas lift production system includes a valve system for controlling the injection of pressurized gas from a source external to the well, such as another gas well or a compressor, into the borehole. The increased pressure from the injected gas forces accumulated formation fluids up a central tubing extending along the borehole to remove the fluids and restore the free flow of gas and/or oil from the formation into the well. In wells where liquid fall back is a problem during gas lift, plunger lift may be combined with gas lift to improve efficiency.

In both plunger lift and gas lift production systems, there is a requirement for the periodic operation of a motor valve at the surface of the wellhead to control either the flow of fluids from the well or the flow of injection gas into the well to assist in the production of gas and liquids from the well. These motor valves are conventionally controlled by timing mechanisms and are programmed in accordance with principles of reservoir engineering which determine the length of time that a well should be either "shut in" and restricted from the flowing of gas or liquids to the surface and the time the well should be "opened" to freely produce. Generally, the criterion used for operation of the motor valve is strictly one of the elapse of a preselected time period. In most cases, measured well parameters, such as pressure, temperature, etc. are used only to override the timing cycle in special conditions.

It will be appreciated that relatively simple, timed intermittent operation of motor valves and the like is often not adequate to control either outflow from the well or gas injection to the well so as to enhance well production. As a consequence, sophisticated computerized controllers have been positioned at the surface of production wells for control of downhole devices such as the motor valves.

In addition, such computerized controllers have been used to control other downhole devices such as hydro-mechanical safety valves. These typically microprocessor based controllers are also used for zone control within a well and, for example, can be used to actuate sliding sleeves or packers by the transmission of a surface command to downhole microprocessor controllers and/or electromechanical control devices.

In recent years, production well control systems have evolved to include complex communication requirements for controlling downhole tools such as various pumps and valves. Many control systems utilize information gathered by downhole sensors and transmitted uphole for determining proper valve and pump control settings. The control settings are transmitted then downhole to control the downhole devices.

Telemetry between the surface controllers and downhole sensors and devices is accomplished using a two-way telemetry system. A two-way system is generally required so that information from the sensors such as pressure, temperature and flow can be sent to the surface for use by the controllers. This data is then processed at the surface by the computerized control system. Electrically submersible pumps use pressure and temperature readings received at the surface from downhole sensors to change the speed of the pump in the borehole.

A signal transmitted to the surface from deep within the well requires sufficient power to ensure a signal-to-noise (S/N) ratio capable or providing useful decoding at the surface. The conventional two-way telemetry system suffers in that sufficient power supplies generally require a relatively large volume. Thus requiring complex and/or expensive downhole power supply designs. Therefore a need exists for a two-way telemetry system that provides good S/N ratio and relatively low downhole power requirements.

SUMMARY OF THE INVENTION

The present invention addresses one or more of the above-identified problems found in conventional well communications systems by providing a semi-passive two way communications apparatus and method sending an acoustic signal using controlled reflected acoustic energy.

One aspect of the invention is an apparatus for transmitting an acoustic signal between a well borehole first location and a second location comprising a signal generator located at the first location for generating an acoustic source signal. A transmitting medium is operatively associated with the signal generator for carrying the acoustic source signal to the second location. A controllable signal reflector disposed at the second location is used to reflect at least a portion of the source signal, the reflected signal being indicative of a parameter of interest. And a receiver is disposed at the first location for receiving the reflected signal.

The transmitting medium may be fluid in a pipe, fluid between the pipe and borehole wall, the pipe itself or even the earth. A signal generator and receiver are selected according to the desired transmitting medium.

The signal generator might be a fluid pump adapted to transmit acoustic energy into the fluid, or the generator might be a device for transmitting acoustic energy into the pipe or the earth.

The receiver might include a hydrophone, a geophone or an accelerometer depending upon the transmitting medium selected.

The reflected signal may be a bi-level echo signal representing a string of binary states or the reflected signal may be a multi-level echo signal.

Another aspect of the present invention is a method for transmitting an acoustic signal between a well borehole first location and a second location comprising generating a source signal from the first location using signal generator. The method includes carrying the source signal to the second location along a transmitting medium operatively associated with the signal generator and reflecting at least a portion of the source signal with a controllable signal reflector disposed at the second location, the reflected signal being indicative of a parameter of interest. The method also includes detecting the reflected signal at the first location with a receiver disposed at the first location for receiving the reflected signal.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DESCRIPTION OF THE PREFERRED EMBODIMENT

Figure 1:
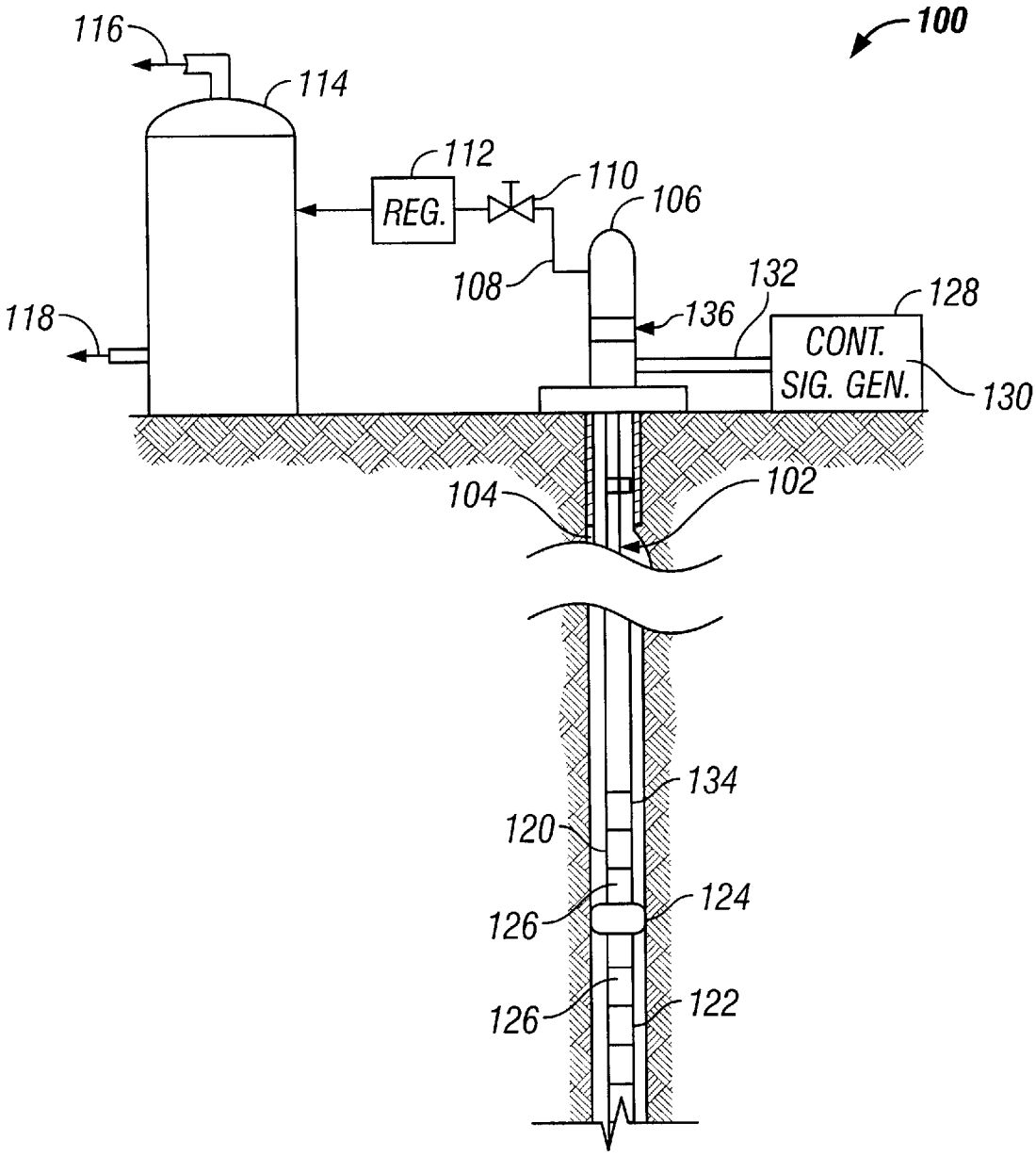
FIG. 1 is an elevation view of a production well system having a communication apparatus according to the present invention.

An embodiment of a production well telemetry system according to the present invention is shown in FIG. 1. The production well system 100 includes a production pipe 102 disposed in a well borehole 104. At the surface a conventional wellhead 106 directs produced fluids through a flow line 108. A control valve 110 and a regulator 112 coupled to the flow line 108 are used to control fluid flow to a separator 114. The separator 114 separates the produced fluid into its component parts of gas 116 and oil 118.

Various downhole controllable devices such as hydromechanical safety valves 122, and sliding sleeves or packers 124 are used for zone control within the well. These devices are preferably operated by downhole microprocessor based controllers 126 or directly controlled by a surface controller 128. The surface controller 128 is used to transmit, for example, a command to the downhole microprocessor controllers 126 and/or the various electromechanical control devices 122 and 124.

The surface controller 128 includes a source signal generator 130 to generate an acoustic source signal comprising a series of acoustic energy pulses. The source signal is transmitted to the downhole devices via the fluid in the annulus between the production pipe and borehole wall or via a fluid line 132 the fluid within the production pipe 102.

A low power signal reflector device 134 such as a controllable diaphragm or a variable volume Helmholz resonator is used to reflect a portion of the source signal as an encoded message containing the parameters measured downhole and/or commands from the downhole microprocessor 126.

The measured parameters originate at downhole sensors 120 coupled to the production pipe 102 to sense parameters such as pressure, temperature, and flow rate, etc. for use in determining automatically control settings for the downhole controllable devices 122 and 124.

An acoustic sensor 136 is located at a selected location, preferably at the surface near or on the wellhead 106. In a preferred embodiment, the sensor 136 is a hydrophone receiver coupled to the wellhead 106 and adapted to detect acoustic energy in the production pipe fluid or annulus fluid. Those skilled in the art would appreciate, however, that other sensors would be useful in detecting acoustic energy as well. For example, accelerometer-type sensors and geophones may also be used as a surface receiver, when the transmission medium is the production pipe or the earth as will be discussed later.

The hydrophone 136 will produce an output indicative of the echo signal sensed. The output of the hydrophone is thus coupled to the surface controller such that the sensed signal is decoded and used by the surface controller to determine and set well control settings. The hydrophone is preferably coupled to the controller via an electrically conductive wire, but the coupling may be any suitable known method of data coupling, such as radio frequency (RF) or inductive coupling.

Figure 2:
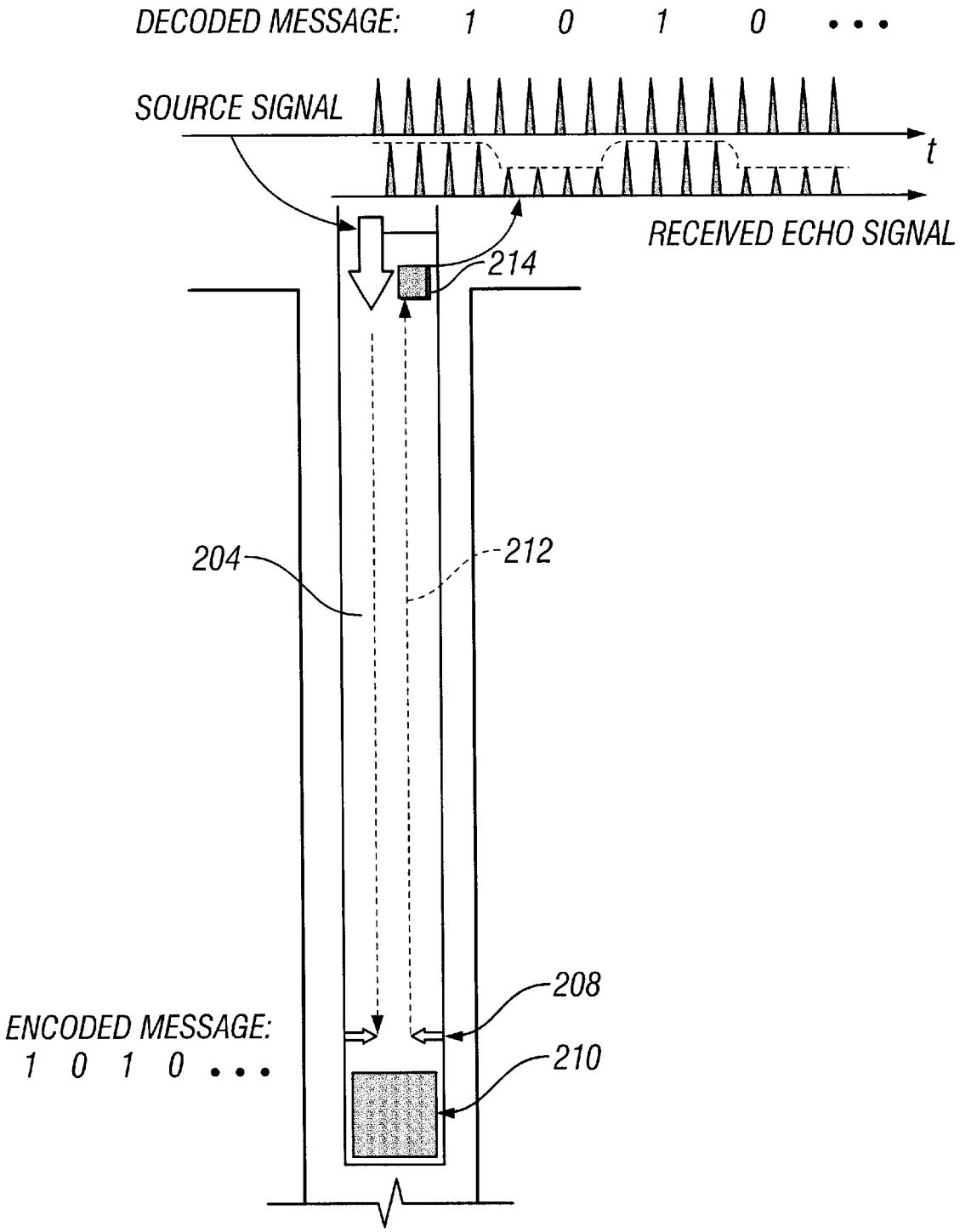
FIG. 2 is a schematic representation of a communications method according to the present invention.

FIG. 2 is a schematic representation of a signal transmitting method 200 used in the system of FIG. 1. Shown is a source signal 202 transmitted to a downhole location via the fluid 204 in a production pipe 206. A downhole control unit 210 controls a downhole controllable reflector 208 to reflect a portion of the source signal 202 as an encoded message intended for transmission to the surface as an echo signal 212. The echo signal 212 is sensed at the surface with a suitable receiver 214 and then decoded using the surface controller described above and shown in FIG. 1.

Figure 3A:
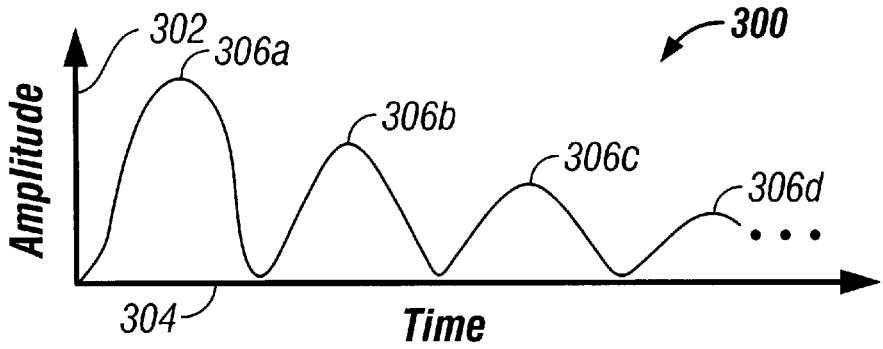
FIGS. 3A–C are plots showing characteristics of various reflection signals.

FIG. 3A is an experimentally derived plot 300 of reflected signal amplitude 302 with respect to time 304. Tests have shown that a reflected signal is adequately distinguishable over background noise in a production well environment over several reflection cycles. A series of reflection pulses 306*a–d* are generated by reflecting a source signal as described above and shown in FIG. 2. Although each successive reflection pulse exhibits a loss in amplitude, tests have shown as many as eight distinguishable reflection signals resulting from a single source signal pulse reflected at a depth of 8000 feet. This characteristic us used according to the present invention to transmit bi-level or multi-level acoustic signals as will now be described.

Figure 3B:
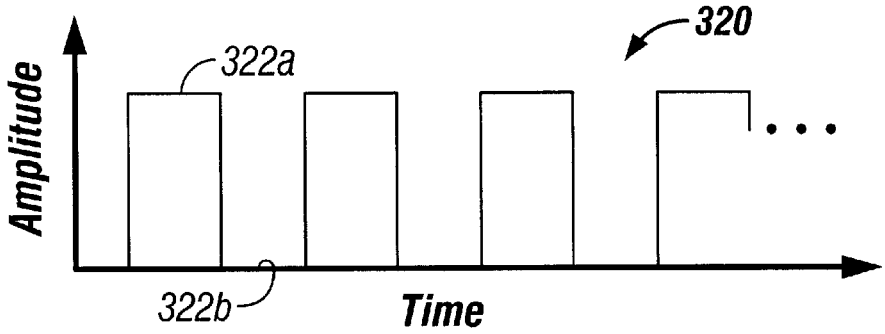

FIG. 3B is an exemplary plot 320 showing bi-level signal transmission. A bi-level signal comprises approximately two amplitude states 322*a–b* of predetermined duration representing binary states of 0 and 1. This transmission method is easily conducted using a two-position diaphragm reflector or a Helmholz volume including a two-position internal volume control device such as a controllable plate or flapper valve. Using either of the diaphragm or controllable volume Helmholz resonator, one position or volume provides a large reflected portion of the source signal, while the second position or volume provides relatively little reflection of the source signal. These two distinct reflections represent binary states of "1" and "0", respectively. Message signals can thus be sent in serial fashion by simply controlling the position of the signal reflector.

As discussed above with respect to FIG. 2, the source signal is a series of pulses at a predetermined frequency. Consequently, any reflected signal will likewise be a multi-pulse signal at the predetermined frequency. The reflected signal, however, might be phase shifted.

Referring back to FIG. 1, the surface receiver 136 detects the reflected signal and transmits the signal to the surface controller 128. The received signal is decoded using a counter (not separately shown) in the controller to count reflected signal pulses or by determining the time during which a reflection remains at one of the two states. For example, a binary string such as 1010 will be encoded by the downhole reflector such that a series of large echo pulses are alternated with a series of lower amplitude echo pulses as shown in FIG. 2.

Figure 3C:
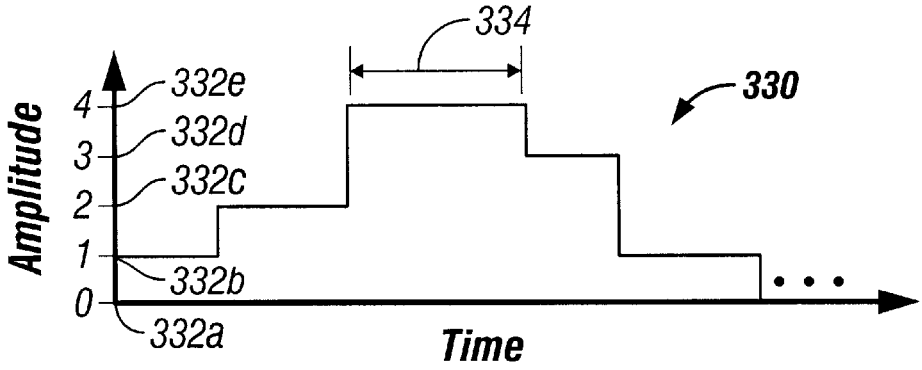

FIG. 3C is a plot 330 illustrating multi-level transmitting. Multi-level transmitting is conducted by using a downhole reflector according to the present invention for reflecting the source signal to provide a reflected signal comprising multiple amplitude states 332–e. For example, a reflector controllably positioned to one of five different states may transmit signal states of 0, 1, 2, 3, and 4. These several states may be used to transmit multiple messages thereby increasing channel capability e.g. the number of sensor output data handling capability. This provides increased capacity for data telemetry. One skilled in the art would appreciate the fact that controlling signal duration 334 at any particular level as shown in FIG. 3 or at any particular state as shown in FIG. 3B is accomplished by control of the reflector position.

Figure 4A:
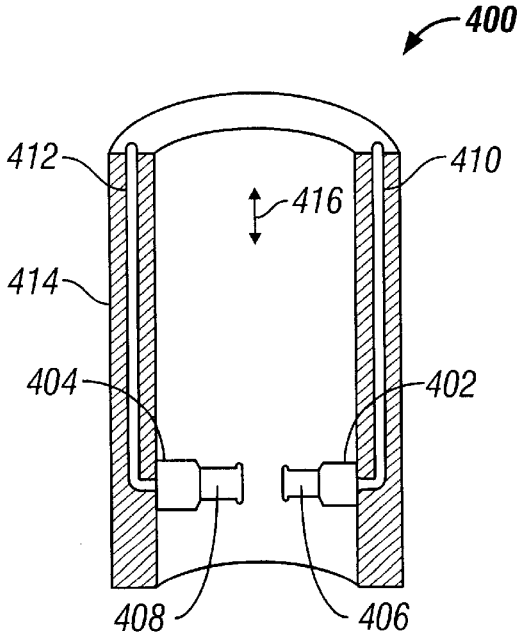
FIGS. 4A–B are alternative embodiments of controllable acoustic reflectors according to the present invention.
Figure 4B:
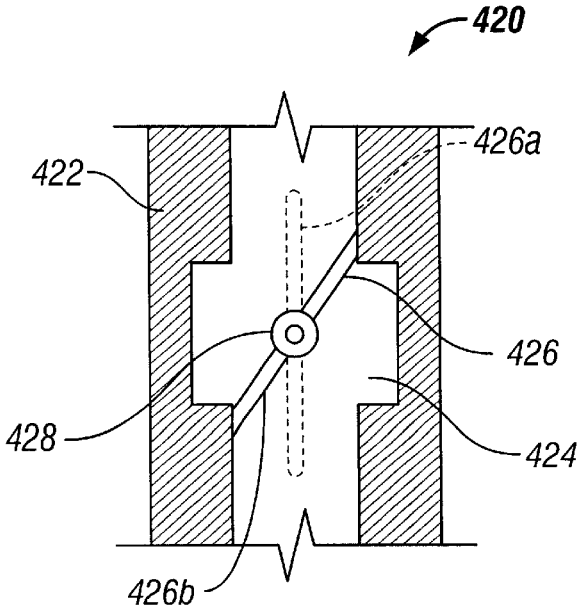

FIGS. 4A and 4B are alternative embodiments for the downhole reflector of FIGS. 1 and 2. FIG. 4A is a controllable diaphragm 400, which as shown, may utilize independently controlled pistons 402, 404. Each piston is controllable to assume a number of positions. In one embodiment, the pistons 402 and 404 each include a corresponding diaphragm element 406 and 408. Each diaphragm element 406 and 408 is a hydraulic-controlled fin-shaped member coupled to the piston and operated by a source pump (not shown) via hydraulic lines 410 and 412. The hydraulic lines 410 and 412 are preferably integral to the tool body 414. The fins 406 and 408 are thus controllable to one of two or more positions to effect the desired reflection characteristic. The source signal will be reflected, and at each fin position, the reflected signal will have distinguishable characteristics such as the amplitude of the signal. The length of time the fin is maintained in a particular position will determine the duration of a reflected signal.

FIG. 4B is an alternative embodiment of a reflector 420 according to the present invention. The downhole reflector 420 includes a tool body 422 having an integral resonator 424. The resonator 424 is, for example, a Helmholz resonator by which reflected signal amplitude and duration are controlled by controlling the volume of the resonator 424.

FIG. 4B shown one embodiment of such a resonator having a two-position flap 426. The flap 426 is mounted to the body 422 on a controllable pivot 428 that allows the flap 426 to be controlled to at least two positions 426*a* and 426*b*. A downhole controller and a stepper motor or solenoid (not shown) are used to control position of the flap 426. The controller moves the flap 426 to a desired position in response to a downhole sensor output.

One position 426*a* of the flap 426 results in little or no reflection of a source signal. A second position 426*b* of the flap 426 results in a substantial reflection of the source signal. Thus a binary string message is easily created that is passively transmitted to the surface as an echo signal by control of the flapper 426.

Figure 5:
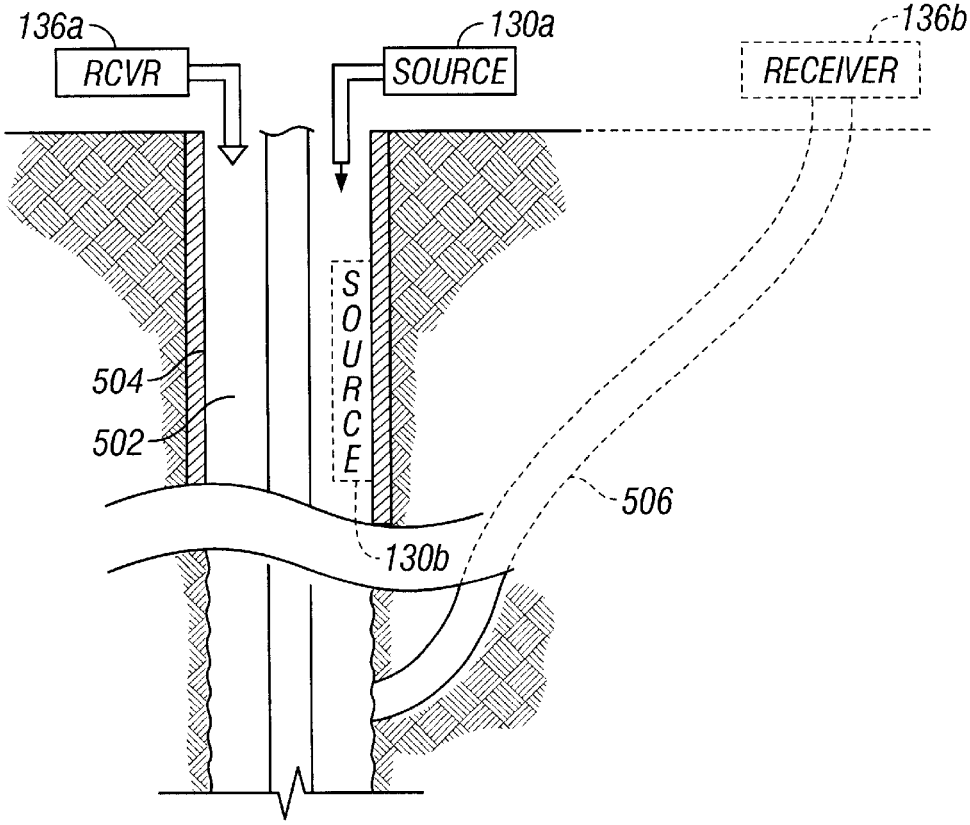
FIG. 5 is a partial elevation view of the system of FIG. 1 showing alternative placements of surface elements of the present invention.

FIG. 5 shows alternative embodiments of the present invention with several locations for the surface receiver 136*a–b* and source signal generator 130*a–b* described above. As discussed above, the fluid in the annulus 502 may used as the transmission medium in these several embodiments of the present invention. The source generator 130*a* may be positioned at the surface to transmit the source signal or the source generator 130*b* may be position within the borehole 504.

In one embodiment the receiver 136*a* is located at a suitable surface location to detect a reflected signal from the main well borehole 504. In another embodiment the receiver 136*b* is located at a surface location to sense a reflected signal using a sensing borehole 506. The sensing borehole 506 is a small borehole drilled to meet the main borehole 504 at a suitable point downhole of all surface equipment associated with the main well operations. In this manner, noise typically generated by such surface equipment is substantially removed from the received echo signal at the sensor 136*b*.

The signal-transmitting medium in an alternative embodiment is not necessarily limited to using the fluid as described above. For example, the transmitting medium might be the production pipe or the earth itself. Well know techniques of inducing an acoustic signal into a pipe include the use of magnetostrictive devices, ceramics and mechanical actuators such as solenoids. Well known techniques using acoustic energy sources such as vibrator trucks, explosives and air guns may be used to induce an acoustic source signal in the earth.

In either case, i.e. using the pipe or earth as the transmission medium, a hydrophone is not used as a receiver. Alternative receivers for these applications include geophones and accelerometers.

Downhole signal reflectors for these alternative embodiments include any suitable controllable device for interrupting the source signal path. One possible technique is to control fluid in a fluid reservoir in the pipe. Changing the fluid pressure or volume in such a reservoir will cause a change in the pipe stiffness, thus effecting a controlled reflection or echo according to the present invention.

Another embodiment includes controlling the one or more downhole packers 124 to interrupt the transmission path. This technique according to the present invention might be employed when using either the pipe 104 or earth as the transmission medium.

Figure 6:
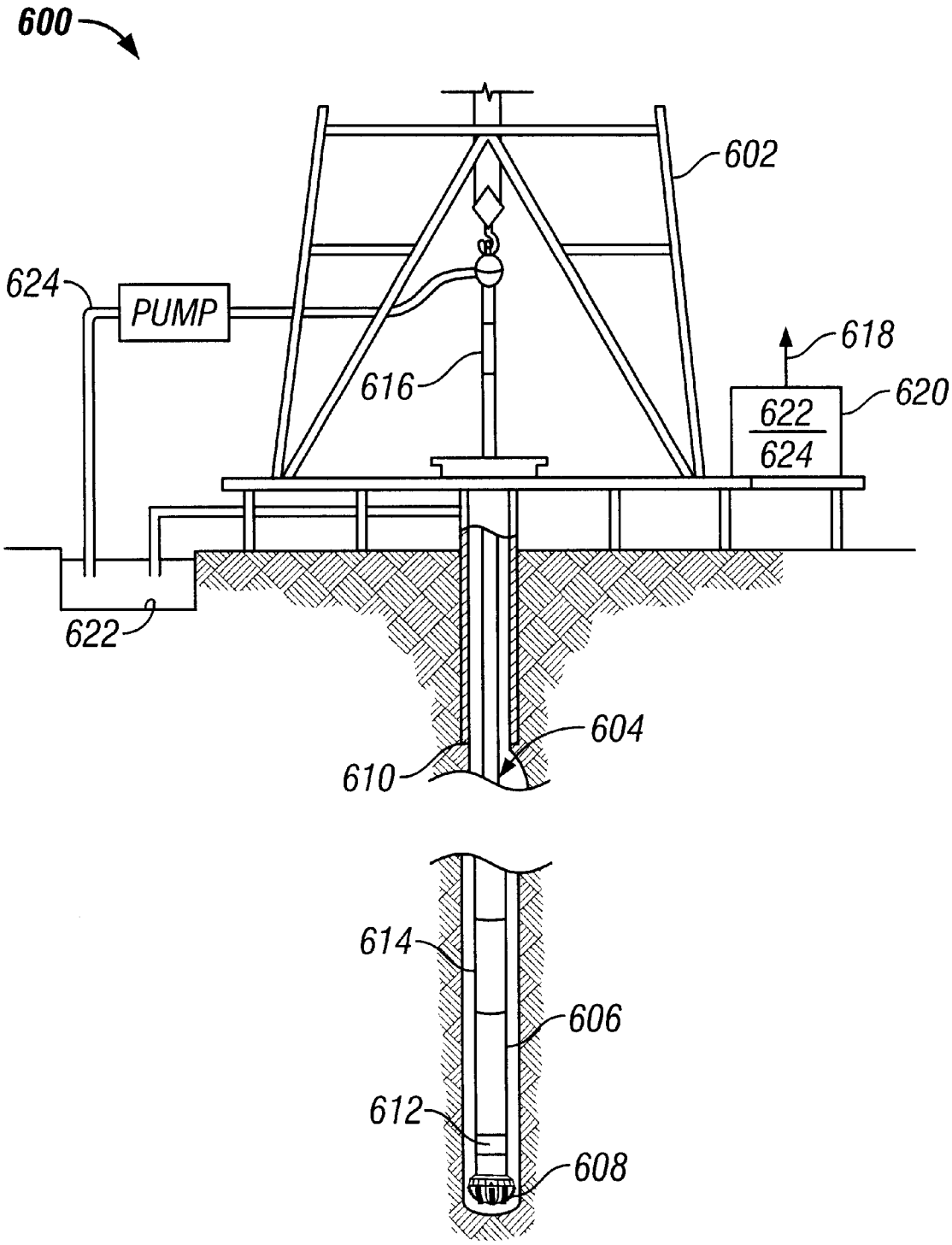
FIG. 6 is and alternative MWD embodiment of the present invention.

The description of the present invention provided thus far has focused on embodiments used in a production well system. The invention, however, is useful in other applications. For example, a measurement-while-drilling system could include a two-way borehole communication apparatus according to the present invention. FIG. 6 is one MWD embodiment according to the present invention. FIG. 6 is an elevation view of a drilling system 600 in a measurement-while-drilling (MWD) arrangement according to the present invention. As would be obvious to one skilled in the art, a completion well system would require reconfiguration; however the basic components would be the same as shown. A conventional derrick 602 supports a drill string 604, which can be a coiled tube or drill pipe. The drill string 604 carries a bottom hole assembly (BHA) 606 and a drill bit 608 at its distal end for drilling a borehole 610 through earth formations.

Drilling operations include pumping drilling fluid or "mud" from a mud pit 622, and using a circulation system 624, circulating the mud through an inner bore of the drill string 604. The mud exits the drill string 604 at the drill bit 608 and returns to the surface through the annular space between the drill string 604 and inner wall of the borehole 610. The mud drives the drilling motor (when used) and it also provides lubrication to various elements of the drill string.

A sensor 612 and a controllable reflector 614 are positioned on the BHA 606. The sensor 612 may be any sensor suited to obtain a parameter of interest of the formation, the formation fluid, the drilling fluid or any desired combination or of the drilling operations. Characteristics measured to obtain to desired parameter of interest may include pressure, flow rate, resistivity, dielectric, temperature, optical properties tool azimuth, tool inclination, drill bit rotation, weight on bit, etc. The output of the sensor 612 is sent to and received by a downhole control unit (not shown separately), which is typically housed within the BHA 606. Alternatively, the control unit may be disposed in any location along the drill string 604. The controller further comprises a power supply (not shown) that may be a battery or mud-driven generator, a processor for processing the signal received from the sensor 612. The reflector 614 may be any of the embodiments as described with respect to FIGS. 4A–B, or any other configuration meeting the intent of the present invention.

The downhole controller controls the acoustic reflector 614 to induce in the drill pipe 604 an acoustic wave signal representative of the sensed parameter. The reflected acoustic wave travels through the drill pipe fluid 604, and is received by an acoustic receiver 616 disposed at a desired location on the drill string 604, but which is typically at the surface. The receiver 616, preferably a hydrophone when the transmitting medium is fluid, converts the acoustic wave to an output representative of the wave, thus representative of the measured downhole parameter. The converted output is then transmitted to a surface controller 620, either by wireless communication or by any conductor suitable for transmitting the output of the receiver 616. The surface controller 620 further comprises a processor 622 for processing the output using a program and an output device 624 such as a display unit for real-time monitoring by operating personnel, a printer, or a data storage device.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. An apparatus for transmitting an acoustic signal between a well borehole first location and a second location comprising:

(a) a signal generator located at the first location for generating an acoustic source signal;

(b) a transmitting medium operatively associated with the signal generator for carrying the acoustic source signal to the second location;

(c) a controllable signal reflector disposed at the second location for reflecting at least a portion of the source signal, the reflected signal being indicative of a parameter of interest; and (d) a receiver disposed at the first location for receiving the reflected signal, wherein the transmission medium comprises a portion of the earth and wherein the signal generator further comprises an energy source for transferring acoustic energy into the earth portion.

2. An apparatus for transmitting an acoustic signal between a well borehole first location and a second location comprising:

(a) a signal generator located at the first location for generating an acoustic source signal;

(b) a transmitting medium operatively associated with the signal generator for carrying the acoustic source signal to the second location;

(c) a controllable signal reflector disposed at the second location for reflecting at least a portion of the source signal, the reflected signal being indicative of a parameter of interest; and (d) a receiver disposed at the first location for receiving the reflected signal, wherein the reflected portion of the source signal comprises an echo signal.

3. An apparatus according to claim 2, wherein the transmitting medium is at least one of (i) fluid in a pipe disposed in the borehole and (ii) fluid in an annular space between the pipe and borehole wall.

4. An apparatus according to claim 3, wherein the signal generator is a fluid pump for generating a series of acoustic pulses with predetermined amplitude and predetermined frequency.

5. An apparatus according to claim 2 further comprising a controller coupled to the signal reflector for controlling the signal reflector in a manner determined at least in part by the parameter of interest.

6. An apparatus according to claim 2, wherein the transmitting medium comprises a pipe disposed in the borehole.

7. An apparatus according to claim 2, wherein the receiver includes one of (i) a hydrophone, (ii) a geophone, and (iii) an accelerometer.

8. An apparatus for transmitting an acoustic signal between a well borehole first location and a second location comprising:

(a) a signal generator located at the first location for generating an acoustic source signal;

(b) a transmitting medium operatively associated with the signal generator for carrying the acoustic source signal to the second location;

(c) a controllable signal reflector disposed at the second location for reflecting at least a portion of the source signal, the reflected signal being indicative of a parameter of interest; and (d) a receiver disposed at the first location for receiving the reflected signal, wherein the signal reflector includes a controllable flap disposed in a section of a pipe in the borehole, the flap adapted to change an internal volume of the pipe section such that the volume change effects one or more distinct reflection characteristics.

9. An apparatus according to claim 2, wherein the echo signal comprises a bi-level signal representing a series of binary states.

10. An apparatus according to claim 2, wherein the echo signal comprises a multi-level signal having a plurality of distinct amplitude levels.

11. An apparatus according to claim 2, wherein the signal generator is disposed at one of (i) a surface location and (ii) within the borehole near the surface.

12. An apparatus according to claim 2, wherein the receiver is disposed at one of (i) a first surface location and (ii) a second surface location connected to the well borehole by a sensing borehole drilled to intercept the well borehole at a downhole location.

13. A method for transmitting an acoustic signal between a borehole first location and a second location, the method comprising:

(a) generating a source signal from the first location using a signal generator;

(b) carrying the source signal to the second location along a transmitting medium operatively coupled to the signal generator;

(c) reflecting at least a portion of the source signal with a controllable signal reflector disposed at the second location, the reflected signal being indicative of a parameter of interest; and (d) detecting the reflected signal at the first location with a receiver, wherein the reflecting a portion of the source signal creates an echo signal.

14. A method according to claim 13, wherein the transmitting medium is at least one of (i) fluid in a pipe disposed in the borehole and (ii) fluid in an annular space between the borehole wall and a pipe disposed in the borehole.

15. A method according to claim 14, wherein the signal generator includes a fluid pump and wherein generating a source signal further comprises using the fluid pump for generating a series of acoustic pulses with predetermined amplitude and predetermined frequency using the fluid pump.

16. A method according to claim 13, wherein reflecting the source signal portion further comprises controlling the signal reflector with a controller coupled to the signal reflector.

17. A method according to claim 13, wherein the transmitting medium is a pipe in the borehole.

18. A method according to claim 13, wherein the signal generator further comprises an energy source for transferring acoustic energy into the earth and wherein the transmitting medium is the earth.

19. A method according to claim 13, wherein the receiver includes at least one of (i) a hydrophone, (ii) a geophone and (iii) an accelerometer.

20. A method for transmitting an acoustic signal between a borehole first location and a second location, the method comprising:

(a) generating a source signal from the first location using a signal generator;

(b) carrying the source signal to the second location along a transmitting medium operatively coupled to the signal generator;

(c) reflecting at least a portion of the source signal with a controllable signal reflector disposed at the second location, the reflected signal being indicative of a parameter of interest; and (d) detecting the reflected signal at the first location with a receiver, wherein reflecting the source signal portion further comprises changing an internal volume of a pipe section in the borehole using a moveable flap such that the volume change effects one or more distinct reflection characteristics.

21. A method according to claim 13, wherein the echo signal comprises a bi-level signal representing a series of binary states.

22. A method according to claim 13, wherein the echo signal comprises a multi-level signal having a plurality of distinct amplitude levels.

23. A method according to claim 13, wherein the signal generator is disposed at one of (i) a surface location and (ii) within the borehole near the surface.

24. A method according to claim 13, wherein the receiver is disposed at one of (i) a first surface location and (ii) a second surface location connected to the borehole by a sensing borehole drilled to intercept the borehole at a downhole location.

* * * * *